US008579676B2

(12) United States Patent
Okada et al.

(10) Patent No.: US 8,579,676 B2
(45) Date of Patent: Nov. 12, 2013

(54) GRINDING MACHINE

(75) Inventors: Kikutoshi Okada, Nagoya (JP); Shinji Deguchi, Aichi (JP); Dai Kiyota, Anjyo (JP)

(73) Assignee: JTEKT Corporation, Osaka-shi (JP)

( * ) Notice: Subject to any disclaimer, the term of this patent is extended or adjusted under 35 U.S.C. 154(b) by 441 days.

(21) Appl. No.: 12/906,542

(22) Filed: Oct. 18, 2010

(65) Prior Publication Data

US 2011/0092139 A1 Apr. 21, 2011

(30) Foreign Application Priority Data

Oct. 19, 2009 (JP) ..... 2009-240307

(51) Int. Cl.
*B24B 49/00* (2012.01)

(52) U.S. Cl.
USPC ..... 451/11; 451/61; 451/195

(58) Field of Classification Search
USPC ..... 451/11, 61, 62, 195
See application file for complete search history.

(56) References Cited

U.S. PATENT DOCUMENTS

| | | | | |
|---|---|---|---|---|
| 2,591,893 | A * | 4/1952 | Trippel | 451/247 |
| 2,910,808 | A * | 11/1959 | Wildhaber | 451/47 |
| 5,335,454 | A * | 8/1994 | Ilek et al. | 451/9 |
| 5,857,896 | A * | 1/1999 | Stollberg | 451/47 |
| 5,899,797 | A * | 5/1999 | Junker | 451/62 |
| 6,200,200 | B1 * | 3/2001 | Himmelsbach | 451/62 |
| 6,685,536 | B1 * | 2/2004 | Junker | 451/5 |
| 7,083,500 | B2 * | 8/2006 | Junker | 451/10 |
| 7,147,547 | B2 * | 12/2006 | Junker | 451/57 |
| 7,393,261 | B2 * | 7/2008 | Junker | 451/5 |
| 7,708,623 | B2 * | 5/2010 | Junker | 451/402 |
| 2009/0111365 | A1 * | 4/2009 | Yoritsune | 451/415 |

FOREIGN PATENT DOCUMENTS

| | | |
|---|---|---|
| JP | 54-295 | 1/1979 |
| JP | 2009-95911 | 5/2009 |
| JP | 2009-101480 | 5/2009 |

* cited by examiner

*Primary Examiner* — Maurina Rachuba
(74) *Attorney, Agent, or Firm* — Oblon, Spivak, McClelland, Maier & Neustadt, L.L.P.

(57) ABSTRACT

A first angular grinding wheel and a straight grinding wheel having rotation axes parallel to each other are arranged on a swivel slide that turns about a turning axis. A reference symmetry plane (MA) that is parallel to a grinding wheel rotation axis and that includes the turning axis and a reference perpendicular plane (MB) that is perpendicular to the reference symmetry plane and that includes the turning axis are defined. A grinding reference point (PA1) of the first angular grinding wheel (TA1) and a grinding reference point (PP1) of the straight grinding wheel (TP1) are arranged asymmetrical with respect to the reference symmetry plane. A distance from the grinding reference point of the straight grinding wheel to the reference symmetry plane is equal to a distance from the grinding reference point of the first angular grinding wheel to the turning axis.

6 Claims, 5 Drawing Sheets

GRINDING MACHINE

INCORPORATION BY REFERENCE/RELATED APPLICATION

This application claims priority to Japanese Patent Application No. 2009-240307 filed on Oct. 19, 2009 the disclosure of which, including the specification, drawings and abstract, is incorporated herein by reference in its entirety.

BACKGROUND OF THE INVENTION

1. Field of the Invention

The invention relates to a grinding machine in which a plurality of grinding wheels are mounted on a swivel slide.

2. Discussion of Background

In an existing art, there are disclosed various grinding machines that are able to perform various types of grinding on a workpiece by turning a swivel slide having a plurality of grinding wheels. For example, Japanese Patent Application Publication No. 2009-095911 (JP-A-2009-095911) describes a grinding machine in which grinding wheels are arranged at front and rear sides of a swivel slide and the grinding wheels are arranged so that the direction of reactive force that occurs during machining is directed toward the center of a turning axis. In addition, Japanese Patent Application Publication No. 2009-101480 (JP-A-2009-101480) describes a grinding machine in which grinding wheels are arranged at front and rear sides of a swivel slide and the positions of the grinding wheel shafts are lowered to thereby make it possible to further improve stiffness. In addition, Japanese Patent Application Publication No. 54-295 (JP-A-54-295) describes a grinding machine that has two types of straight grinding wheels, that is, a straight grinding wheel that grinds a journal portion of a crankshaft and a straight grinding wheel that grinds a pin portion of the crankshaft, arranged on a swivel slide and that has a structure for changing the grinding wheels by turning the swivel slide 180 degrees.

In the existing techniques described in JP-A-2009-095911 and JP-A-2009-101480, the swivel slide is turned by a direct drive motor, the swivel slide has a rotor and a stator inside, and, furthermore, the grinding wheels are provided at the front and rear sides of the swivel slide. For this reason, the swivel slide is thick, the size of the swivel slide is large when regarded as a casing, and the weight of the swivel slide is also heavy. Thus, the size of a drive motor that moves the swivel slide toward or away from a workpiece also increases, so that the size of the grinding machine increases. In addition, the grinding wheels are provided on the side surfaces of the swivel slide, so that the position of each swivel slide cannot be adjusted in a direction to approach the turning axis. In addition, when the swivel slide is turned in order to change the grinding wheels for grinding a workpiece, it takes time to turn the swivel slide a having large size and a heavy weight. This elongates the machining time.

When the swivel slide is formed in a plate-like shape and then grinding wheels are arranged on the swivel slide in order to reduce the size and weight of the swivel slide, it is possible to reduce the apparent size and weight of the swivel slide, and the flexibility of arrangement of the grinding wheels increases. However, it is necessary to arrange a drive motor, such as a servo motor, for turning the swivel slide so as to protrude upward from the swivel slide as in the case of JP-A-54-295. A ball screw, or the like, for moving the swivel slide forward or backward is arranged below the swivel slide, and it is considerably difficult to arrange a turning drive motor below the swivel slide, so that not only the height increases but also grinding wheels must be arranged around the turning drive motor. Furthermore, unless the plurality of grinding wheels are arranged at appropriate positions, after turning the swivel slide in order to change the grinding wheel that grinds a workpiece, a relative displacement between the swivel slide and the workpiece increases to thereby elongate the machining time. However, in the existing art, the arrangement of the grinding wheels is determined in consideration only of the balance as the swivel slide and interference with a headstock or a workpiece during turning.

SUMMARY OF INVENTION

An object of the invention is to provide a grinding machine, with which it is possible to further reduce the size of a swivel slide, further reduce the machining time and, in addition, reduce the overall size of the grinding machine by further reduce the size of the swivel slide provided with a plurality of grinding wheels and arranging the grinding wheels, arranged on the swivel slide, at further appropriate positions.

According to a feature of an example of the invention, a swivel slide is turned at an angle other than 180 degrees from a position at which a first grinding wheel grinds a workpiece to a position at which a second grinding wheel grinds the workpiece.

In addition, a first grinding wheel grinding reference point and a second grinding wheel grinding reference point are arranged at appropriate positions. By so doing, it is possible to further reduce the size of the swivel slide, further reduce the machining time, and reduce the overall size of the grinding machine.

According to another feature of an example of the invention, in a grinding machine in which two types of grinding wheel devices, that is, a first angular grinding wheel device and a straight grinding wheel device, are mounted on a swivel slide, it is possible to further reduce the size of the swivel slide. In addition, grinding wheels are arranged on the swivel slide at further appropriate positions. By so doing, it is possible to further reduce the size of the swivel slide, further reduce the machining time, and reduce the overall size of the grinding machine.

According to a further feature of an example of the invention, after the swivel slide is turned to change the first angular grinding wheel and the straight grinding wheel, a travel distance by which the swivel slide and the workpiece are relatively moved in an approaching direction is made substantially zero, so that it is possible to further reduce the machining time, and reduce the overall size of the grinding machine.

According to another feature of the invention, by way of example, in a grinding machine in which two types of grinding wheel devices, that is, a first angular grinding wheel device and a second angular grinding wheel device, are mounted on a swivel slide, it is possible to further reduce the swivel slide. In addition, grinding wheels are arranged on the swivel slide at further appropriate positions. By so doing, it is possible to further reduce the size of the swivel slide, further reduce the machining time, and reduce the overall size of the grinding machine.

Further by way of example, according to another feature of the invention, after the swivel slide is turned to change the first angular grinding wheel and the second angular grinding wheel, a travel distance by which the swivel slide and the workpiece are relatively moved in an approaching direction is made substantially zero, so that it is possible to further reduce the machining time, and reduce the overall size of the grinding machine.

BRIEF DESCRIPTION OF DRAWINGS

The features, advantages, and technical and industrial significance of this invention will be described below with reference to the accompanying drawings, in which like numerals denote like elements, and wherein.

DETAILED DESCRIPTION OF EMBODIMENTS

Hereinafter, embodiments of the invention will be described with reference to the accompanying drawings.

Figure 1A:
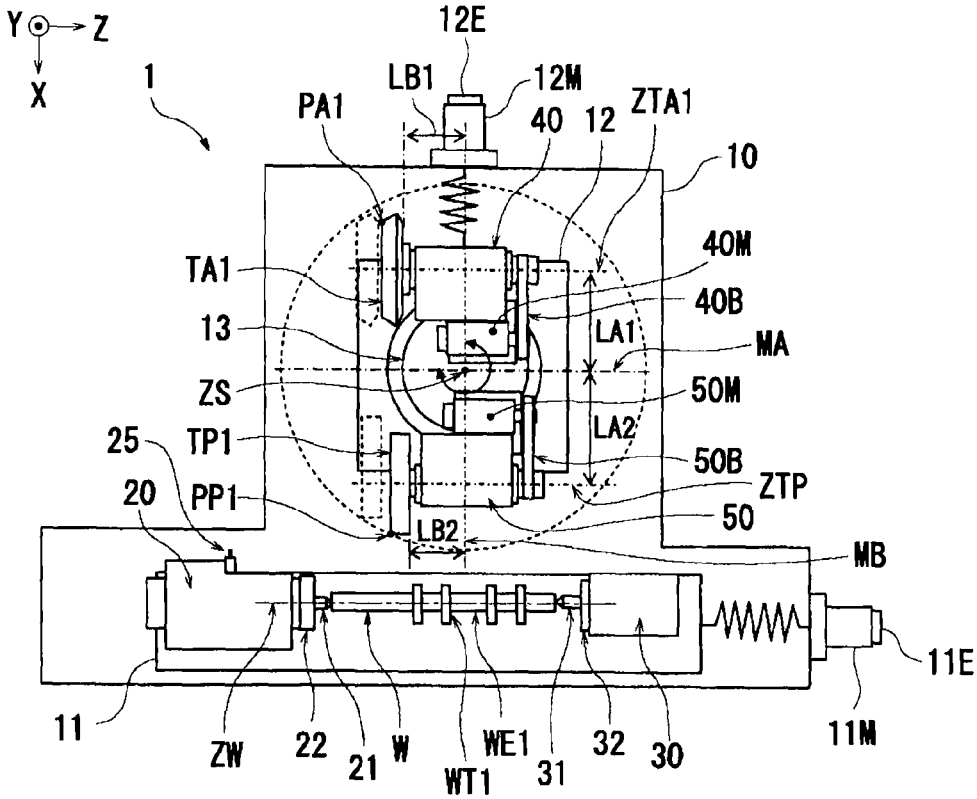
FIG. 1(A) is a plan view of a grinding machine 1 according to a first embodiment.
Figure 1B:
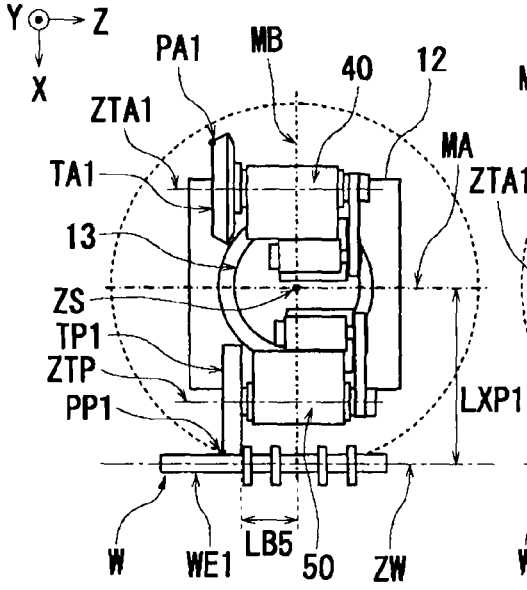
FIG. 1(B) is a diagram that illustrates a position at which a straight grinding wheel TP1 grinds a workpiece W.
Figure 1C:
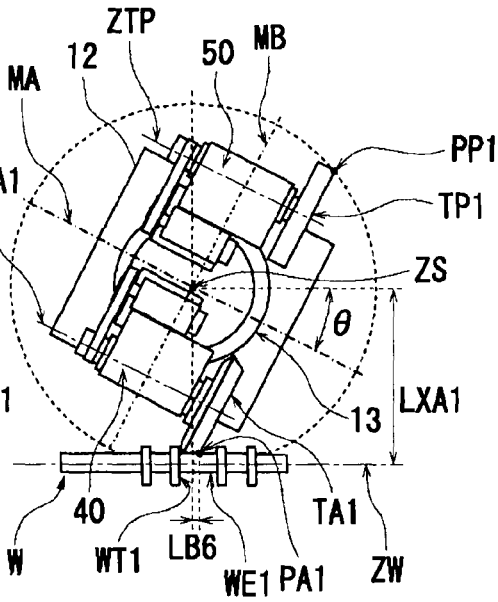
FIG. 1(C) is a diagram that illustrates a position at which a first angular grinding wheel TA1 grinds the workpiece W.

FIG. 1(A) shows an example of a plan view of a grinding machine 1 according to a first embodiment of the invention. FIG. 1(B) shows a position at which a straight grinding wheel TP1 grinds a workpiece W. FIG. 1(C) shows a position at which a first angular grinding wheel TA1 grinds the workpiece W. Note that, in the drawings, X-axis, Y-axis and Z-axis are perpendicular to one another, Y-axis represents a vertically upward direction, Z-axis represents a direction along a workpiece rotation axis ZW that is the rotation axis of the workpiece W, and X-axis represents a direction in which a swivel slide 12 is moved forward or backward.

First Embodiment

Next, the grinding machine 1 according to the first embodiment will be described with reference to FIG. 1(A) to FIG. 3(C). In the first embodiment, the grinding machine 1 includes the first angular grinding wheel TA1 and the straight grinding wheel TP1, and the first angular grinding wheel TA1 and the straight grinding wheel TP1 are arranged at appropriate positions on a further small swivel slide 12. As shown in FIG. 1(A), the grinding machine 1 includes a base 10, a workhead table 11, and the swivel slide 12. The workhead table 11 is reciprocally movable in the Z-axis direction on the base 10. The swivel slide 12 is reciprocally movable in the X-axis direction on the base 10. The swivel slide 12 is rotatable about a turning axis ZS parallel to the Y-axis. Note that a controller (numerical control device, or the like) that controls movable portions is not shown in the drawing. The workhead table 11 is reciprocally moved in the Z-axis direction by a Z-axis drive motor 11M and a feed screw (not shown). The controller outputs a control signal to the Z-axis drive motor 11M while detecting a signal from a position detector 11E, such as an encoder, to thereby position the workhead table 11 in the Z-axis direction. The swivel slide 12 is reciprocally moved in the X-axis direction by an X-axis drive motor 12M and a feed screw (not shown). The controller outputs a control signal to the X-axis drive motor 12M while detecting a signal from a position detector 12E, such as an encoder, to thereby position the swivel slide 12 in the X-axis direction.

A headstock 20 and a tailstock 30 are mounted on the workhead table 11. The headstock 20 includes a center member 21. The tailstock 30 includes a center member 31. The center member 21 and the center member 31 are arranged along a workpiece rotation axis ZW parallel to the Z-axis direction. In addition, the headstock 20 is provided with a truing device 25 for truing a grinding wheel. The center member 21 is provided for a main shaft 22. The main shaft 22 is provided with a drive motor (not shown). The controller is able to rotate the main shaft 22 at a selected angular velocity to a selected angle around the workpiece rotation axis ZW passing the distal end of the center member 21. The center member 31 is provided for a tailstock shaft 32. The tailstock shaft 32 is rotatably or nonrotatably supported. Both ends of the workpiece W are respectively supported by the center member 21 and the center member 31. The center members may be replaced with chucks. The workpiece W has at least a first cylindrical surface WE1 having a first predetermined diameter and a first end surface WT1 perpendicular to the first cylindrical surface WE1. The workpiece W is ground by the first angular grinding wheel TA1 and the straight grinding wheel TP1.

The swivel slide 12 is formed in a plate-like shape so as to further reduce its size. A turning motor 13 is provided near the center of the swivel slide 12 so as to protrude in the Y-axis direction (see FIG. 2). The controller outputs a control signal to the turning motor 13 while detecting a signal from an angle detector, such as an encoder, to thereby control the turning angle of the swivel slide 12. Then, two types of grinding wheel devices, that is, a first angular grinding wheel device 40 and a straight grinding wheel device 50, are arranged on the swivel slide 12 so as to sandwich the turning motor 13. The first angular grinding wheel device 40 includes the first angular grinding wheel TA1 (corresponding to a first grinding wheel). The straight grinding wheel device 50 includes the straight grinding wheel TP1 (corresponding to a second grinding wheel). Note that a first grinding wheel rotation axis ZTA1 that is the rotation axis of the first angular grinding wheel TA1 is parallel to a second grinding wheel rotation axis ZTP that is the rotation axis of the straight grinding wheel TP1, and the first grinding wheel rotation axis ZTA1 and the second grinding wheel rotation axis ZTP are perpendicular to the turning axis ZS. The first angular grinding wheel TA1 and the straight grinding wheel TP1 are assembled at one ends, that is, on the same side, in a direction along the first grinding wheel rotation axis ZTA1 and a direction along the second grinding wheel rotation axis ZTP. As shown in FIG. 1(A), the first angular grinding wheel TA1 and the straight grinding wheel TP1 are assembled at the left end. In addition, the first angular grinding wheel TA1 is driven for rotation by a grinding wheel drive motor 40M via a belt 40B. The straight grinding wheel TP1 is driven for rotation by a grinding wheel drive motor 50M via a belt 50B. In addition, the grinding machine 1 includes a coolant nozzle (not shown) for supplying coolant to the vicinity of a contact portion (grinding point) between the workpiece W and the grinding wheel.

Figure 2A:
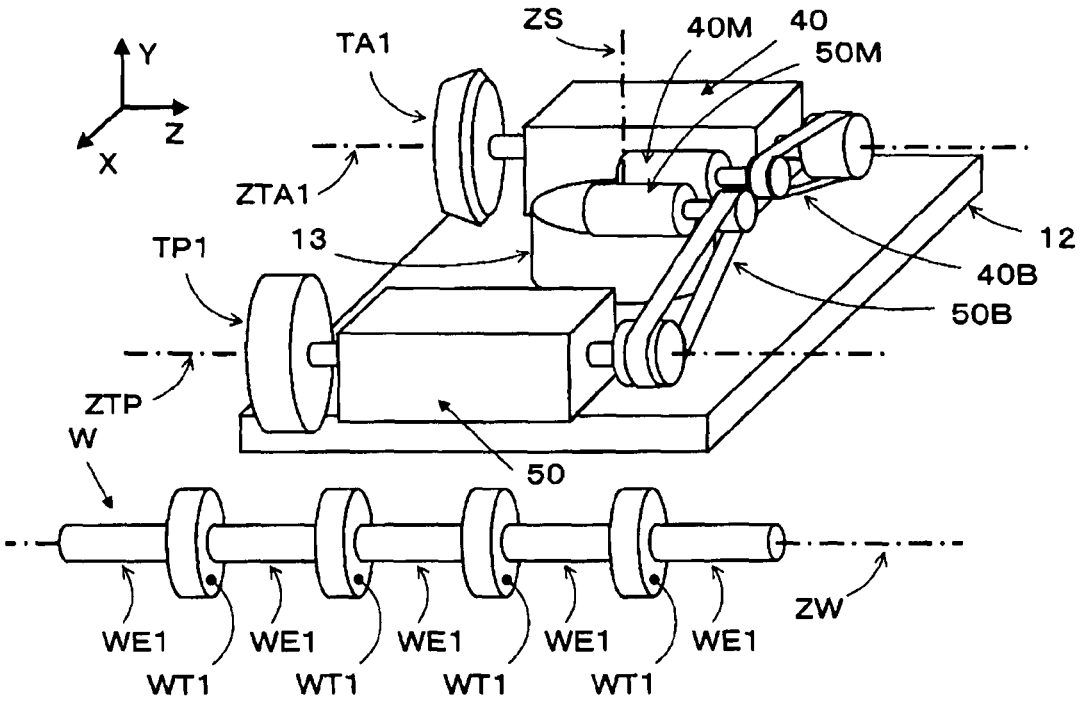
FIG. 2(A) is a perspective view that illustrates a schematic assembled state of a workpiece W, first angular grinding wheel device 40, straight grinding wheel device 50, and the like, according to the first embodiment.
Figure 2B:
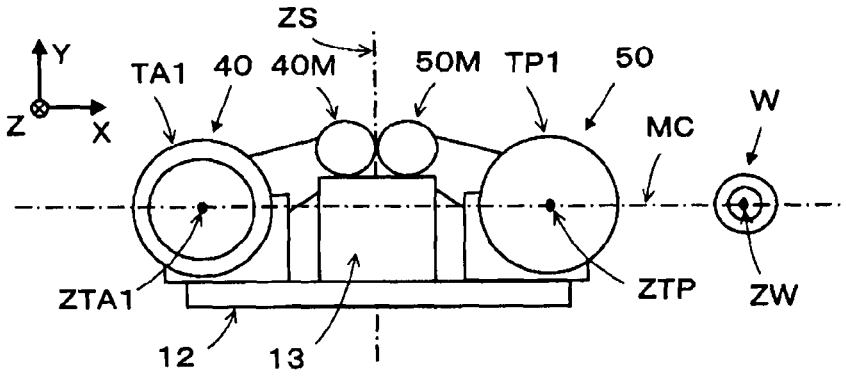
FIG. 2(B) is a side view of the schematic assembled state of the workpiece W, first angular grinding wheel device 40, straight grinding wheel device 50, and the like, according to the first embodiment.

The first angular grinding wheel TA1 has at least two types of circular conical surfaces, as grinding surfaces, that are inclined with respect to the first grinding wheel rotation axis ZTA1. As shown in FIG. 1(C), the first angular grinding wheel TA1 is able to grind the first cylindrical surface WE1 and first end surface WT1 of the workpiece W at the same time. The straight grinding wheel TP1 has a grinding surface parallel to the second grinding wheel rotation axis ZTP. As shown in FIG. 1(B), the straight grinding wheel TP1 is able to grind the first cylindrical surface WE1 of the workpiece W. Note that, as shown in FIG. 2(B), the workpiece rotation axis ZW, the first grinding wheel rotation axis ZTA1, and the second grinding wheel rotation axis ZTP are arranged along a relative movement plane MC perpendicular to the turning axis ZS. Note that FIG. 1(B) shows a state where the swivel slide 12 is turned to bring the swivel slide 12 close to the workpiece W so as to place the straight grinding wheel TP1 at a straight grinding wheel machining position to grind the first cylindrical surface WE1 of the workpiece W. In addition, FIG. 1(C) shows a state where the swivel slide 12 is turned 180 degrees +θ (other than 180 degrees) from the state shown in FIG. 1(B) to bring the swivel slide 12 close to the workpiece W so as to place the first angular grinding wheel TA1 at a first angular grinding wheel machining position to grind the first cylindrical surface WE1 and first end surface WT1 of the workpiece W.

Here, a reference symmetry plane MA and a reference perpendicular plane MB are virtually set (defined). The reference symmetry plane MA includes the turning axis ZS and is parallel to the first grinding wheel rotation axis ZTA1 and the second grinding wheel rotation axis ZTP. The reference perpendicular plane MB is perpendicular to the reference symmetry plane MA and includes the turning axis ZS. Then, a first angular grinding wheel grinding reference point PA1 (see FIG. 1(A)) is set. The first angular grinding wheel grinding reference point PA1 is a portion (see FIG. 1(C)) at which the first angular grinding wheel TA1 grinds the first cylindrical surface WE1 of the workpiece W, and is one end (at which the first angular grinding wheel TA1 is provided) in the direction along the first grinding wheel rotation axis ZTA1. In addition, a straight grinding wheel grinding reference point PP1 (see FIG. 1(A)) is set. The straight grinding wheel grinding reference point PP1 is a portion (see FIG. 1(B)) at which the straight grinding wheel TP1 grinds the first cylindrical surface WE1 of the workpiece W, and is one end (at which the straight grinding wheel TP1 is provided) in the direction along the second grinding wheel rotation axis ZTP.

Figure 3A:
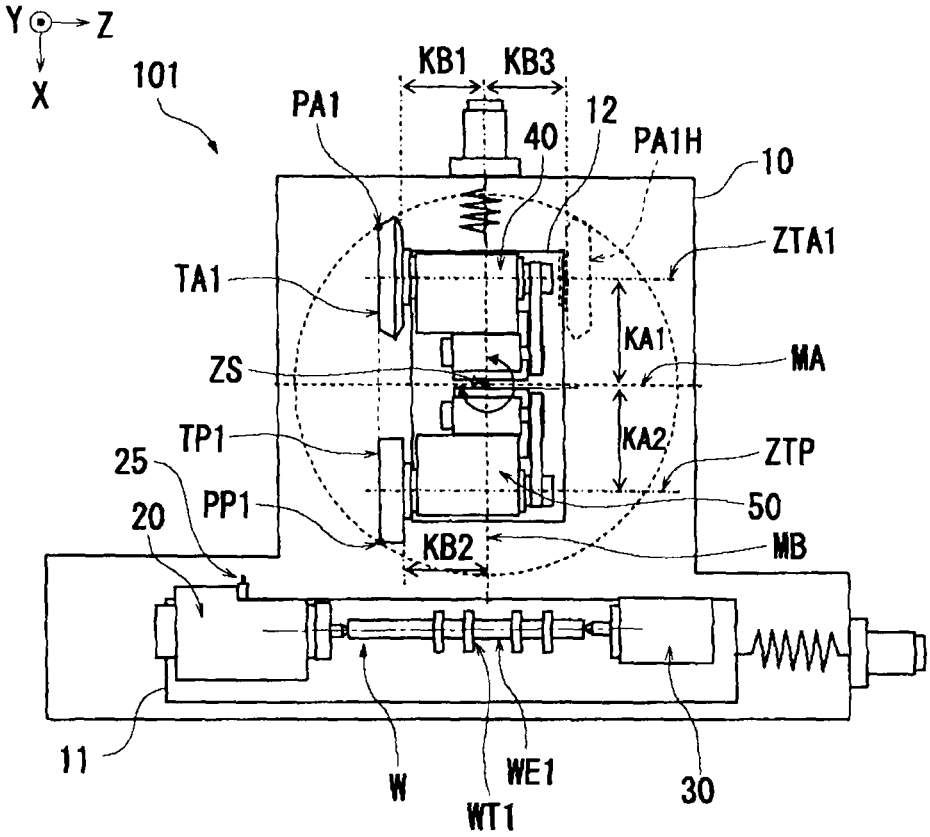
FIG. 3(A) to FIG. 3(C) are diagrams that illustrate an existing grinding machine 101 in which a first angular grinding wheel device 40 and a straight grinding wheel device 50 are arranged symmetrically with respect to a reference symmetry plane MA.
Figure 3B:
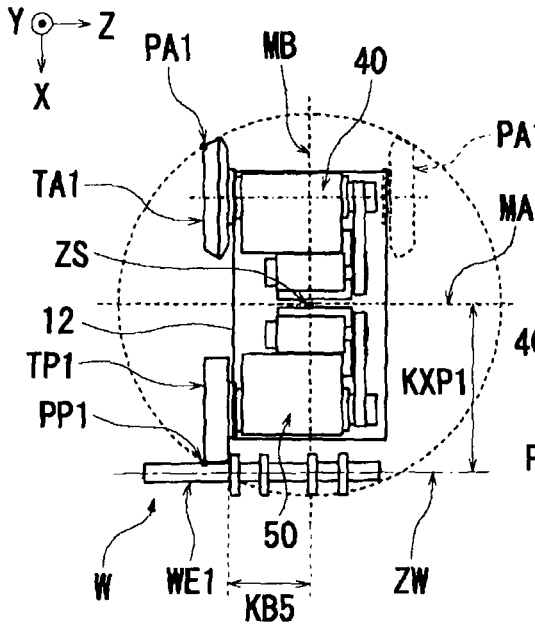
Figure 3C:
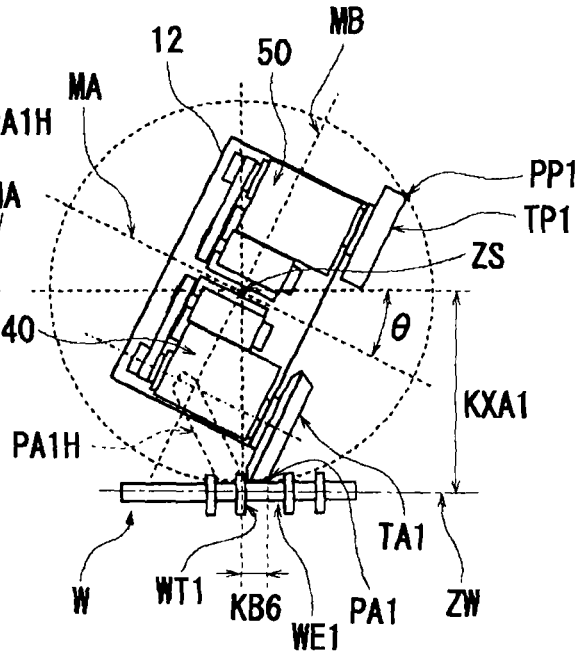

In an existing grinding machine 101 (grinding machine having a first angular grinding wheel and a straight grinding wheel) shown in FIG. 3(A) to FIG. 3(C), the first angular grinding wheel TA1 and the straight grinding wheel TP1 are arranged so that the first angular grinding wheel grinding reference point PA1 and the straight grinding wheel grinding reference point PP1 are symmetrical with respect to the reference symmetry plane MA (set so that distance KB1=distance KB2 and distance KA1=distance KA2). Note that the distance KB1 is a distance from an end surface of the first angular grinding wheel TA1, adjacent to the reference perpendicular plane MB, to the reference perpendicular plane MB, and the distance KB2 is a distance from an end surface of the straight grinding wheel TP1, adjacent to the reference perpendicular plane MB, to the reference perpendicular plane MB. In addition, the distance KA1 is a distance from the first grinding wheel rotation axis ZTA1 to the reference symmetry plane MA, and the distance KA2 is a distance from the second grinding wheel rotation axis ZTP to the reference symmetry plane MA. Note that there is an existing grinding machine in which the first angular grinding wheel TA1 is arranged at a position PA1H indicated by the dotted line. In this case, the first angular grinding wheel grinding reference point is arranged at a position at which the first angular grinding wheel grinding reference point and the straight grinding wheel grinding reference point PP1 are point-symmetrical with respect to the turning axis ZS.

In contrast to this, in the grinding machine 1 according to the present embodiment shown in FIG. 1(A), FIG. 1(B), and FIG. 1(C), the first angular grinding wheel grinding reference point PA1 and the straight grinding wheel grinding reference point PP1 are arranged asymmetrical with respect to the reference symmetry plane MA. In the first embodiment, the straight grinding wheel grinding reference point PP1 is arranged at a position closer to the reference perpendicular plane MB than the first angular grinding wheel grinding reference point PA1 (distance LB1>distance LB2 in FIG. 1(A)), and the straight grinding wheel grinding reference point PP1 is arranged at a position farther from the reference symmetry plane MA than the first angular grinding wheel grinding reference point PA1 (distance LA1<distance LA2 in FIG. 1(A)). Note that, as shown in FIG. 1(A), the distance LB1 is a distance from an end surface of the first angular grinding wheel TA1, adjacent to the reference perpendicular plane MB, to the reference perpendicular plane MB, and the distance LB2 is a distance from an end surface of the straight grinding wheel TP1, adjacent to the reference perpendicular plane MB, to the reference perpendicular plane MB. In addition, the distance LA1 is a distance from the first grinding wheel rotation axis ZTA1 to the reference symmetry plane MA, and the distance LA2 is a distance from the second grinding wheel rotation axis ZTP to the reference symmetry plane MA. Note that the first angular grinding wheel and the straight grinding wheel may be arranged so as to satisfy at least one of the condition that the straight grinding wheel grinding reference point PP1 is positioned closer to the reference perpendicular plane MB than the first angular grinding wheel grinding reference point PA1 and the condition that the straight grinding wheel grinding reference point PP1 is positioned farther from the reference symmetry plane MA than the first angular grinding wheel grinding reference point PA1.

With the above arrangement, as shown in FIG. 1(B) and FIG. 1(C), a distance LXA1 from the workpiece rotation axis ZW to the turning axis ZS when the first angular grinding wheel TA1 is used to grind the first cylindrical surface WE1 and first end surface WT1 of the workpiece W may be substantially equal to a distance LXP1 from the workpiece rotation axis ZW to the turning axis ZS when the straight grinding wheel TP1 is used to grind the first cylindrical surface WE1 of the workpiece W. By so doing, when the swivel slide 12 is turned to change the grinding wheels, a new travel distance in the X-axis direction is further reduced, so that it is possible to further reduce the machining time.

Here, as shown in FIG. 1(B), when the workpiece W is ground by the straight grinding wheel TP1, a distance in the Z-axis direction from an end surface of the straight grinding wheel TP1, adjacent to the reference perpendicular plane MB, to the turning axis ZS is set to a straight grinding wheel grinding distance LB5. In addition, as shown in FIG. 1(C), when the workpiece W is ground by the first angular grinding wheel TA1, a distance in the Z-axis direction from the first angular grinding wheel grinding reference point PA1 to the turning axis ZS is set to a first angular grinding wheel grinding distance LB6. With the arrangement of the present embodiment, it is possible to make the total length of the straight grinding wheel grinding distance LB5 and the first angular grinding wheel grinding distance LB6 shorter than the total length of a distance KB5 and a distance KB6 in the existing grinding machine 101 shown in FIG. 3(B) and FIG. 3(C).

By so doing, when the swivel slide 12 is turned to change the grinding wheels, a new travel distance in the Z-axis direction is further reduced, so that it is possible to not only further reduce the machining time but also reduce the overall size of the grinding machine in the Z-axis direction. Particularly, when the grinding wheel is trued by the truing device 25, it is necessary to relatively move the truing device 25 and the grinding wheel so that the truing device 25 is placed in front of the grinding wheel. In the existing grinding machine shown in FIG. 3(A) to FIG. 3(C), because a positional deviation in the Z-axis direction is large when the straight grinding wheel and the first angular grinding wheel are turned to their grinding positions, the table needs to be moved by that much, so that the overall size of the grinding machine increases.

With the arrangement of the present embodiment (particularly, when the distance from the straight grinding wheel grinding reference point to the reference symmetry plane is set to be equal to the distance from the first angular grinding wheel grinding reference point to the turning axis), a positional deviation between the straight grinding wheel and the first angular grinding wheel is small and therefore, the travel distance of the table (swivel slide) for truing is small, so that it is possible to further reduce the overall size of the grinding machine.

Note that setting such that distance LXP1=distance LXA1 and distance LB6=0 (zero) in FIG. 1(B) and FIG. 1(C), that is, setting such that the distance from the straight grinding wheel grinding reference point to the reference symmetry plane is equal to the distance from the first angular grinding wheel grinding reference point to the turning axis, is more desirable. In addition, setting such that distance LXP1=distance LXA1 and distance LB6=distance LB5=0 (zero) is employed, the position of the first angular grinding wheel grinding reference point is located at the same position as the position of the straight grinding wheel grinding reference point when the swivel slide is turned to change the grinding wheels and therefore, a new travel distance in the X-axis direction and a new travel distance in the Z-axis direction are further reduced, so that it is possible to reduce the machining time and the size of the grinding machine.

In the existing grinding machine 101 shown in FIG. 3(A) to FIG. 3(C), because the straight grinding wheel grinding reference point PP1 and the first angular grinding wheel grinding reference point PA1 are arranged symmetrically with respect to the reference symmetry plane MA, a distance KXP1 from the workpiece rotation axis ZW to the turning axis ZS at the straight grinding wheel machining position is greatly different from a distance KXA1 from the workpiece rotation axis ZW to the turning axis ZS at the first angular grinding wheel machining position as shown in FIG. 3(B) and FIG. 3(C) in which the swivel slide 12 is turned 180 degrees+θ, and there is a new travel distance in the X-axis direction when the swivel slide 12 is turned to change the grinding wheels. Thus, not only the machining time elongates as compared with that of the grinding machine 1 according to the present embodiment but also the overall size of the grinding machine becomes large to allow for a deviation.

In addition, the total length of the distance KB5 and the distance KB6 shown in FIG. 3(B) and FIG. 3(C) is longer than the total length of the straight grinding wheel grinding distance LB5 and the first angular grinding wheel grinding distance LB6 shown in FIG. 1(B) and FIG. 1(C), and there is a new travel distance in the Z-axis direction when the swivel slide 12 is turned 180 degrees +θ to change the grinding wheels, so that the machining time elongates as compared with that of the grinding machine 1 according to the present embodiment, and the size of the grinding machine also increases.

Second Embodiment

Next, a grinding machine 2 according to a second embodiment will be described with reference to FIG. 4(A) to FIG. 5(C). In the second embodiment, the grinding machine 2 includes a first angular grinding wheel TA1 and a second angular grinding wheel TA2, and the first angular grinding wheel TA1 and the second angular grinding wheel TA2 are arranged at appropriate positions on a further small swivel slide 12. The difference from the first embodiment will be mainly described. Note that, in FIG. 4(A) to FIG. 5(C), components other than the first angular grinding wheel TA1, the second angular grinding wheel TA2, the workpiece W, and the swivel slide 12 are not shown. Note that, in the second embodiment, the workpiece W has at least a first cylindrical surface WE1 having a first predetermined diameter, a first end surface WT1 perpendicular to the first cylindrical surface WE1, a second cylindrical surface WE2 having a second predetermined diameter different from the first predetermined diameter, a second end surface WT2 perpendicular to the second cylindrical surface WE2, and an end surface WT11 that is a step between the first cylindrical surface WE1 and the second cylindrical surface WE2.

Figure 4A:
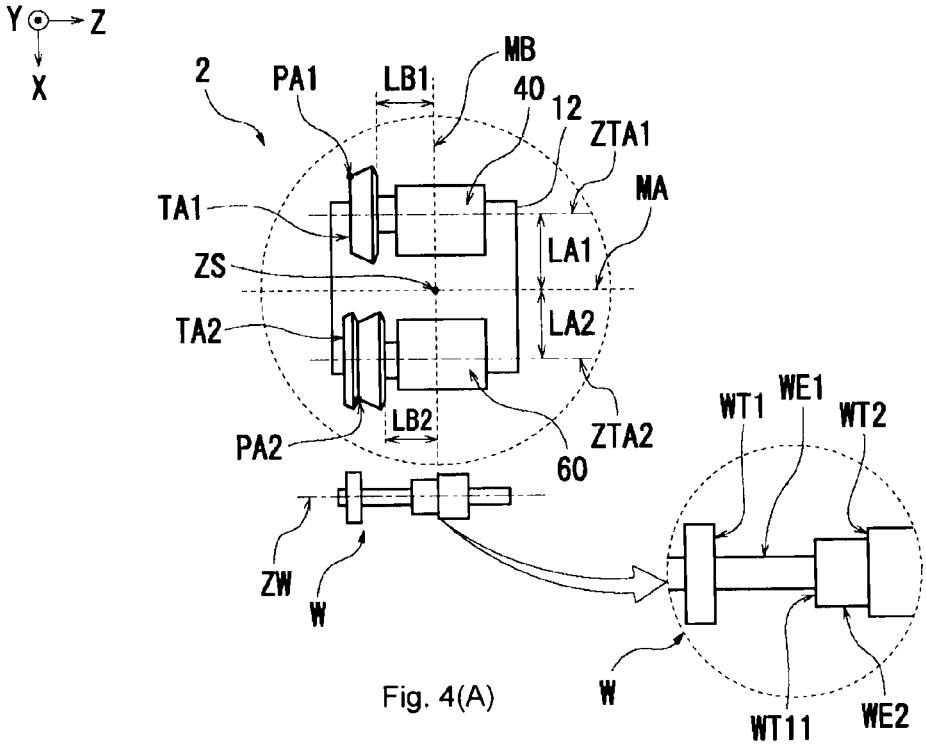
FIG. 4(A) is a plan view of a grinding machine 2 according to a second embodiment.
Figure 4B:
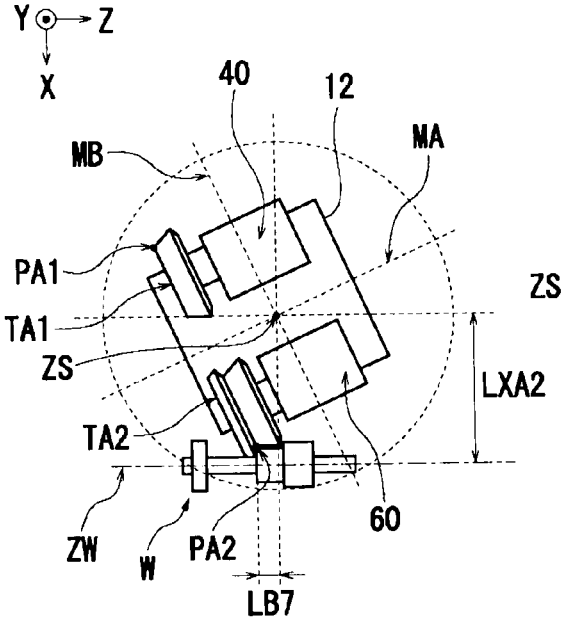
FIG. 4(B) is a diagram that illustrates a position at which a second angular grinding wheel TA2 grinds a workpiece W.
Figure 4C:
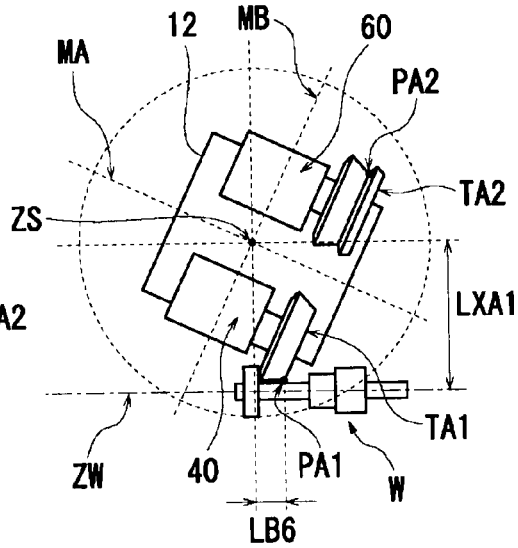
FIG. 4(C) is a diagram that illustrates a position at which a first angular grinding wheel TA1 grinds the workpiece W.

The first angular grinding wheel TA1 has two types of circular conical surfaces, as grinding surfaces, that are inclined with respect to the first grinding wheel rotation axis ZTA1, and is able to grind the first cylindrical surface WE1 and first end surface WT1 of the workpiece W at the same time, as shown in FIG. 4(C). The second angular grinding wheel TA2 has at least two types (four types in the example shown in FIG. 4(A) to FIG. 4(C)) of circular conical surfaces, as grinding surfaces, that are inclined with respect to the second grinding wheel rotation axis ZTA2, and is able to grind at least the second cylindrical surface WE2 and second end surface WT2 of the workpiece W at the same time, as shown in FIG. 4(B). In the example shown in FIG. 4(A) to FIG. 4(C), the second angular grinding wheel TA2 is able to grind the second cylindrical surface WE2, the second end surface WT2, the end surface WT11 of the step between the first cylindrical surface WE1 and the second cylindrical surface WE2, and the first cylindrical surface WE1 near the step at the same time.

Note that, as in the case of the first embodiment, the workpiece rotation axis ZW, the first grinding wheel rotation axis ZTA1, and the second grinding wheel rotation axis ZTA2 are arranged along the relative movement plane MC perpendicular to the turning axis ZS.

Note that FIG. 4(B) shows a state where the swivel slide 12 is turned to bring the swivel slide 12 close to the workpiece W so as to place the second angular grinding wheel TA2 at a second angular grinding wheel machining position to grind the second cylindrical surface WE2 of the workpiece W. In addition, FIG. 4(C) shows a state where the swivel slide 12 is turned 180 degrees+θ (other than 180 degrees) from the state shown in FIG. 4(B) to bring the swivel slide 12 close to the workpiece W so as to place the first angular grinding wheel TA1 at a first angular grinding wheel machining position to grind the first cylindrical surface WE1 and first end surface WT1 of the workpiece W.

Here, as in the case of the first embodiment, a reference symmetry plane MA and a reference perpendicular plane MB are virtually set (defined). The reference symmetry plane MA includes the turning axis ZS and is parallel to the first grinding wheel rotation axis ZTA1 and the second grinding wheel rotation axis ZTA2. The reference perpendicular plane MB is perpendicular to the reference symmetry plane MA and includes the turning axis ZS. Then, a first angular grinding wheel grinding reference point PA1 (see FIG. 4(A)) is set. The first angular grinding wheel grinding reference point PA1 is a portion (see FIG. 4(C)) at which the first angular grinding wheel TA1 grinds the first cylindrical surface WE1 of the workpiece W, and is one end (at which the first angular grinding wheel TA1 is provided) in the direction along the first grinding wheel rotation axis ZTA1. In addition, a second angular grinding wheel grinding reference point PA2 (see FIG. 4(A)) is set. The second angular grinding wheel grinding reference point PA2 is a portion (see FIG. 4(B)) at which the second angular grinding wheel TA2 grinds the second cylindrical surface WE2 of the workpiece W, and is one end (at which the second angular grinding wheel TA2 is provided) in the direction along the second grinding wheel rotation axis ZTA2.

Figure 5A:
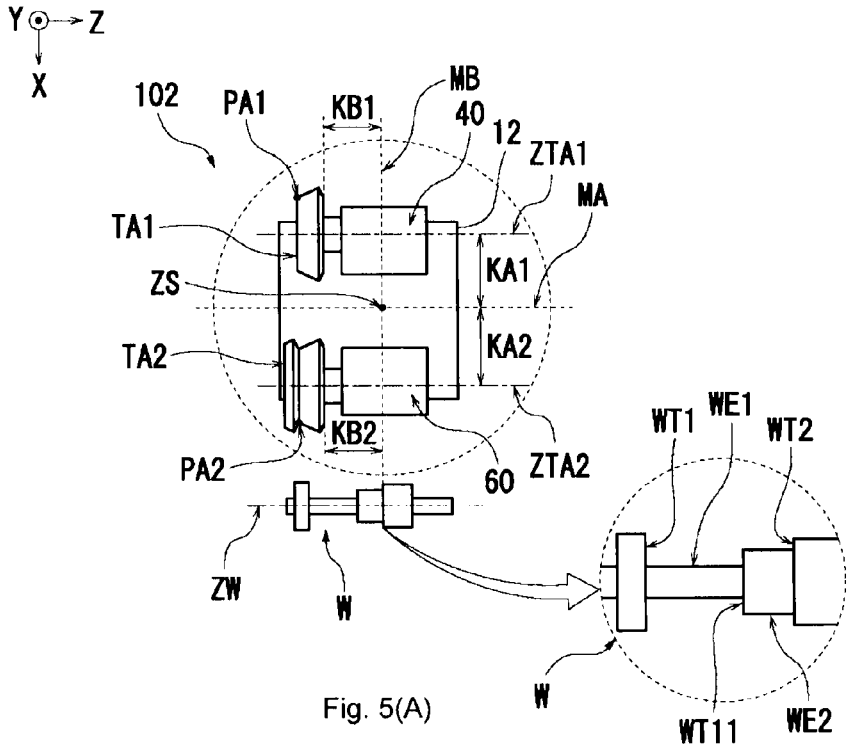
FIG. 5(A) to FIG. 5(C) are diagrams that illustrate an existing grinding machine 102 in which a first angular grinding wheel device 40 and a second angular grinding wheel device 60 are arranged symmetrically with respect to a reference symmetry plane MA.
Figure 5B:
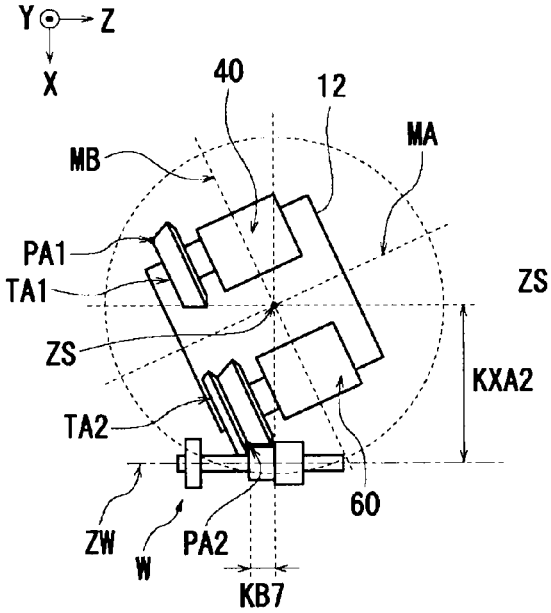
Figure 5C:
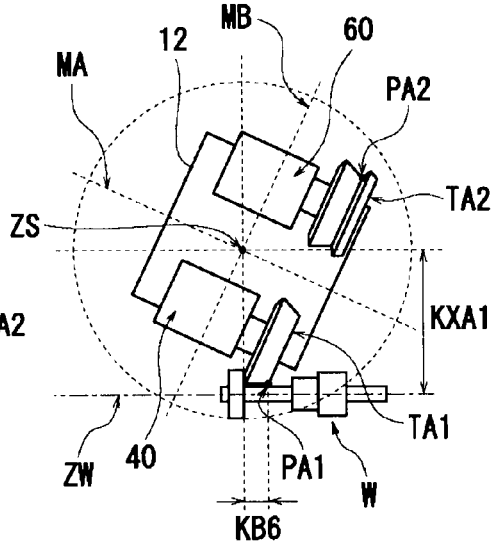

In an existing grinding machine 102 (grinding machine having a first angular grinding wheel and a second angular grinding wheel) shown in FIG. 5(A) to FIG. 5(C), the first angular grinding wheel TA1 and the second angular grinding wheel TA2 are arranged so that the first angular grinding wheel grinding reference point PA1 and the second angular grinding wheel grinding reference point PA2 are symmetrical with respect to the reference symmetry plane MA (set so that distance KB1=distance KB2 and distance KA1=distance KA2).

In contrast to this, in the grinding machine 2 according to the present embodiment shown in FIG. 4(A), FIG. 4(B), and FIG. 4(C), the first angular grinding wheel grinding reference point PA1 and the second angular grinding wheel grinding reference point PA2 are not arranged symmetrical with reference to the reference symmetry plane MA. In the second embodiment, the second angular grinding wheel grinding reference point PA2 is arranged at a position closer to the reference perpendicular plane MB than the first angular grinding wheel grinding reference point PA1 (distance LB1>distance LB2 in FIG. 4(A)), and the second angular grinding wheel grinding reference point PA2 is arranged at a position closer to the reference symmetry plane MA than the first angular grinding wheel grinding reference point PA1 (distance LA1>distance LA2 in FIG. 4(A)). Note that the first angular grinding wheel and the second angular grinding wheel may be arranged so as to satisfy at least one of the condition that the second angular grinding wheel grinding reference point PA2 is closer to the reference perpendicular plane MB than the first angular grinding wheel grinding reference point PA1 and the condition that the second angular grinding wheel grinding reference point PA2 is closer to the reference symmetry plane MA than the first angular grinding wheel grinding reference point PA1.

With the above arrangement, as in the case of the first embodiment, as shown in FIG. 4(B) and FIG. 4(C), it is possible to make the distance LXA1 substantially equal to a distance LXA2 from the workpiece rotation axis ZW to the turning axis ZS when the second angular grinding wheel TA2 is used to grind the second cylindrical surface WE2 of the workpiece W. By so doing, when the swivel slide 12 is turned to change the grinding wheels, a new travel distance in the X-axis direction is further reduced, so that it is possible to not only further reduce the machining time but also reduce the overall size of the grinding machine.

Here, as shown in FIG. 4(B), when the workpiece W is ground by the second angular grinding wheel TA2, a distance in the Z-axis direction from the second angular grinding wheel grinding reference point PA2 to the turning axis ZS is set to a second angular grinding wheel grinding distance LB7. In addition, as shown in FIG. 4(C), when the workpiece W is ground by the first angular grinding wheel TA1, a distance in the Z-axis direction from the first angular grinding wheel grinding reference point PA1 to the turning axis ZS is set to a first angular grinding wheel grinding distance LB6. With the arrangement of the present embodiment, it is possible to make the total length of the second angular grinding wheel grinding distance LB7 and the first angular grinding wheel grinding distance LB6 shorter than the total length of a distance KB7 and a distance KB6 in the existing grinding machine 102 shown in FIG. 5(B) and FIG. 5(C). By so doing, when the swivel slide 12 is turned to change the grinding wheels, a new travel distance in the Z-axis direction is further reduced, so that it is possible to reduce the machining time and make the overall size of the grinding machine more compact.

In the existing grinding machine 102 shown in FIG. 5(A), because the second angular grinding wheel grinding reference point PA2 and the first angular grinding wheel grinding reference point PA1 are arranged symmetrically with respect to the reference symmetry plane MA, a distance KXA2 from the workpiece rotation axis ZW to the turning axis ZS at the second angular grinding wheel machining position is greatly different from a distance KXA1 from the workpiece rotation axis ZW to the turning axis ZS at the first angular grinding wheel machining position as shown in FIG. 5(B) and FIG. 5(C), and there is a new travel distance in the X-axis direction when the swivel slide 12 is turned to change the grinding wheels. Thus, not only the machining time elongates as compared with that of the grinding machine 2 according to the present embodiment but also the width of the grinding machine increases.

In addition, the total length of the distance KB7 and the distance KB6 shown in FIG. 5(B) and FIG. 5(C) is longer than the total length of the second angular grinding wheel grinding distance LB7 and the first angular grinding wheel grinding distance LB6 shown in FIG. 4(B) and FIG. 4(C), and there is a new travel distance in the Z-axis direction when the swivel slide 12 is turned to change the grinding wheels, so that the machining time elongates as compared with that of the grinding machine 2 according to the present embodiment, and the size of the grinding machine elongates and increases.

With the grinding machines 1 and 2 described in the above embodiments, it is possible to reduce the size of the grinding machine by reducing the thickness of the swivel slide to a thickness that is smaller than that of the existing swivel slide, and in addition, since the grinding wheel devices are arranged on the swivel slide, the flexibility of arrangement of the grinding wheel devices increases. In addition, the grinding wheel devices are arranged at appropriate positions by taking advantage of the high flexibility of arrangement to thereby further reduce a travel distance after the swivel slide is turned to change the grinding wheels. By so doing, it is possible to reduce the machining time and the overall size of the grinding machine.

The grinding machine of the invention is not limited to the appearance, configuration, structure, and the like, described in the above embodiments; various modifications, additions, and omissions may be made without departing from the scope of the invention. For example, the arrangement of the grinding wheels shown in FIG. 1(A) may be changed so that the orientation in which the angular grinding wheel and the straight grinding wheel are supported is opposite as indicated by the broken line PA1H in FIG. 3(A). In this case, an end surface of the first angular grinding wheel TA1, adjacent to the reference perpendicular plane MB, is located at a symmetrical position with respect to the reference perpendicular plane MB and the relationship, distance LB1>distance LB2 and distance LA1<distance LA2, remains unchanged.

While the grinding machine 1 according to the first embodiment includes the straight grinding wheel and the angular grinding wheel, and the grinding machine 2 according to the second embodiment includes the angular grinding wheel and the angular grinding wheel, the grinding machine may include a straight grinding wheel and a straight grinding wheel. In this case, the grinding machine may also be applied to a case where a tapered surface is ground by the straight grinding wheel. That is, the grinding machine may be applied to a case where a machining position of one of the grinding wheels is set as a reference and then a machining position of the other one of the grinding wheels is a position that is obtained by turning the swivel slide by degrees other than 180 degrees (180 degrees±θ (θ is not equal to zero)).

The grinding machines 1 and 2 according to the above first and second embodiments are examples configured so that the first angular grinding wheel TA1 (or the straight grinding wheel TP1 or the second angular grinding wheel TA2) is movable in the X-axis direction with respect to the workpiece W, and the workpiece W is movable in the Z-axis direction with respect to the first angular grinding wheel TA1 (or the straight grinding wheel TP1 or the second angular grinding wheel TA2); however, it suffices that the first angular grinding wheel TA1 (or the straight grinding wheel TP1 or the second angular grinding wheel TA2) is movable relative to the work piece W in the X-axis direction and the Z-axis direction (movable along an XZ plane (corresponding to a relative movement plane)).

In addition, in the grinding machines 1 and 2 according to the above first and second embodiments, a manner of supporting the grinding wheels is of an open-side type; instead, a manner of supporting the grinding wheels may be of a dual-support type. Note that the shape and configuration of the first and second angular grinding wheels and the shape of the workpiece W are not limited to the ones described in the above embodiments.

What is claimed is:

1. A grinding machine comprising:

a swivel slide that turns about a turning axis perpendicular to a plane including a workpiece rotation axis; and a first grinding wheel and a second grinding wheel that are arranged on the swivel slide and that are used to grind an outer peripheral surface of a workpiece, wherein the swivel slide is turned at an angle other than 180 degrees from a position at which the first grinding wheel grinds the workpiece to a position at which the second grinding wheel grinds the workpiece, the swivel slide is configured to be movable with respect to the workpiece, wherein a plane that includes the turning axis and is parallel to a first grinding wheel rotation axis and a second grinding wheel rotation axis is defined as a reference symmetry plane, wherein a first grinding wheel grinding reference point is a portion at which the first grinding wheel grinds the workpiece and is one end in a direction along the first grinding wheel rotation axis, a second grinding wheel grinding reference point is a portion at which the second grinding wheel grinds the workpiece and is one end in a direction along the second grinding wheel rotation axis, and the first grinding wheel grinding reference point and the second grinding wheel grinding reference point are arranged asymmetrical with respect to the reference symmetry plane, and wherein a position of the first grinding wheel and a position of the second grinding wheel are set so that a distance from the second grinding wheel grinding reference point to the reference symmetry plane is equal to a distance from the first grinding wheel grinding reference point to the turning axis.

2. The grinding machine according to claim 1, wherein the position of the first grinding wheel and the position of the second grinding wheel are set so that a position of the first grinding wheel grinding reference point when the swivel slide is turned to bring the swivel slide close to the workpiece so as to place the first grinding wheel at a position to grind the workpiece is equal to a position of the second grinding wheel grinding reference point when the swivel slide is turned to bring the swivel slide close to the workpiece so as to place the second grinding wheel at a position to grind the workpiece.

3. A grinding machine comprising:

a swivel slide, including a turning motor, that turns about a turning axis perpendicular to a plane including a workpiece rotation axis; and a first angular grinding wheel device and a straight grinding wheel device that are arranged on the swivel slide and that are used to grind a workpiece at least having a cylindrical surface parallel to the workpiece rotation axis and an end surface that adjoins to and intersects with the cylindrical surface, wherein the first angular grinding wheel device includes a first angular grinding wheel that has at least two types of circular conical surfaces, as grinding surfaces, inclined with respect to a first grinding wheel rotation axis perpendicular to the turning axis and that is able to grind the cylindrical surface and end surface of the workpiece, the straight grinding wheel device includes a straight grinding wheel that has a grinding surface parallel to a second grinding wheel rotation axis parallel to the first grinding wheel rotation axis and that is able to grind the cylindrical surface of the workpiece, and the first angular grinding wheel device and the straight grinding wheel device are arranged on the swivel slide so as to sandwich the turning motor that turns the swivel slide, the swivel slide is configured to be movable with respect to the workpiece, wherein a plane that includes the turning axis and is parallel to the first grinding wheel rotation axis and the second grinding wheel rotation axis is defined as a reference symmetry plane, wherein a first angular grinding wheel grinding reference point is a portion at which the first angular grinding wheel grinds the cylindrical surface of the workpiece and is one end in a direction along the first grinding wheel rotation axis, a straight grinding wheel grinding reference point is a portion at which the straight grinding wheel grinds the cylindrical surface of the workpiece and is one end in a direction along the second grinding wheel rotation axis, and the first angular grinding wheel grinding reference point and the straight grinding wheel grinding reference point are arranged asymmetrical with respect to the reference symmetry plane, and wherein a position of the first angular grinding wheel and a position of the straight grinding wheel are set so that a distance from the straight grinding wheel grinding reference point to the reference symmetry plane is equal to a distance from the first angular grinding wheel grinding reference point to the turning axis.

4. A grinding machine comprising:

a swivel slide, including a turning motor, that turns about a turning axis perpendicular to a plane including a workpiece rotation axis; and a first angular grinding wheel device and a straight grinding wheel device that are arranged on the swivel slide and that are used to grind a workpiece at least having a cylindrical surface parallel to the workpiece rotation axis and an end surface that adjoins to and intersects with the cylindrical surface, wherein the first angular grinding wheel device includes a first angular grinding wheel that has at least two types of circular conical surfaces, as grinding surfaces, inclined with respect to a first grinding wheel rotation axis perpendicular to the turning axis and that is able to grind the cylindrical surface and end surface of the workpiece, the straight grinding wheel device includes a straight grinding wheel that has a grinding surface parallel to a second grinding wheel rotation axis parallel to the first grinding wheel rotation axis and that is able to grind the cylindrical surface of the workpiece, and the first angular grinding wheel device and the straight grinding wheel device are arranged on the swivel slide so as to sandwich the turning motor that turns the swivel slide, the swivel slide is configured to be movable with respect to the workpiece, wherein a plane that includes the turning axis and is parallel to the first grinding wheel rotation axis and the second grinding wheel rotation axis is defined as a reference symmetry plane, and a plane that is perpendicular to the reference symmetry plane and includes the turning axis is defined as a reference perpendicular plane, wherein a first angular grinding wheel grinding reference point is a portion at which the first angular grinding wheel grinds the cylindrical surface of the workpiece and is one end in a direction along the first grinding wheel rotation axis, a straight grinding wheel grinding reference point is a portion at which the straight grinding wheel grinds the cylindrical surface of the workpiece and is one end in a direction along the second grinding wheel rotation axis, and the first angular grinding wheel grinding reference point and the straight grinding wheel grinding reference point are arranged asymmetrical with respect to the reference symmetry plane, and wherein a position of the first angular grinding wheel and a position of the straight grinding wheel are set so as to satisfy at least one of a condition that the straight grinding wheel grinding reference point is positioned closer to the reference perpendicular plane than the first angular grinding wheel grinding reference point and a condition that the straight grinding wheel grinding reference point is positioned farther from the reference symmetry plane than the first angular grinding wheel grinding reference point.

5. The grinding machine according to claim 4, wherein the position of the first angular grinding wheel and the position of the straight grinding wheel are set so that a distance from the workpiece rotation axis to the turning axis when the swivel slide is turned to bring the swivel slide close to the workpiece so as to place the first angular grinding wheel at a first angular grinding wheel machining position to grind the cylindrical surface and end surface of the workpiece is equal to a distance from the workpiece rotation axis to the turning axis when the swivel slide is turned to bring the swivel slide close to the workpiece so as to place the straight grinding wheel at a straight grinding wheel machining position to grind the cylindrical surface of the workpiece.

6. The grinding machine according to claim 3, wherein the position of the first angular grinding wheel and the position of the straight grinding wheel are set so that a position of the first angular grinding wheel grinding reference point when the swivel slide is turned to bring the swivel slide close to the workpiece so as to place the first angular grinding wheel at the first angular grinding wheel machining position to grind the cylindrical surface and end surface of the workpiece is equal to a position of the straight grinding wheel grinding reference point when the swivel slide is turned to bring the swivel slide close to the workpiece so as to place the straight grinding wheel at the straight grinding wheel machining position to grind the cylindrical surface of the workpiece.

* * * * *